US008955439B2

(12) United States Patent
Kuwana et al.

(10) Patent No.: US 8,955,439 B2
(45) Date of Patent: Feb. 17, 2015

(54) PRINTING SYSTEM AND PRINTING APPARATUS USING CONTINUOUS RECORDING SHEET, AND CONVEYANCE CONTROL METHOD OF CONTINUOUS RECORDING SHEET

(75) Inventors: Kohji Kuwana, Ibaraki (JP); Masahiro Mizuno, Ibaraki (JP); Mitsunobu Gouda, Ibaraki (JP)

(73) Assignee: Ricoh Company Limited, Tokyo (JP)

( * ) Notice: Subject to any disclaimer, the term of this patent is extended or adjusted under 35 U.S.C. 154(b) by 544 days.

(21) Appl. No.: 13/005,813

(22) Filed: Jan. 13, 2011

(65) Prior Publication Data

US 2011/0176851 A1 Jul. 21, 2011

(30) Foreign Application Priority Data

Jan. 20, 2010 (JP) ..... 2010-009938
Dec. 24, 2010 (JP) ..... 2010-287976

(51) Int. Cl.

| | |
|---|---|
| ***B41J 29/38*** | (2006.01) |
| ***B41J 3/54*** | (2006.01) |
| ***G03G 15/00*** | (2006.01) |
| ***B41J 3/60*** | (2006.01) |

(52) U.S. Cl.

CPC ..... *B41J 3/546* (2013.01); *G03G 15/6517* (2013.01); *B41J 29/38* (2013.01); *B41J 3/60* (2013.01); *G03G 15/657* (2013.01); *G03G 2215/00021* (2013.01); *G03G 2215/00455* (2013.01); *Y10S 101/42* (2013.01)

USPC ..... 101/483; 101/484; 101/DIG. 42; 399/384

(58) Field of Classification Search

CPC .. B65H 13/066; B65H 26/04; B65H 2211/00; B65H 2301/4492; B65H 2515/322; B65H 23/06; B65H 23/063; B65H 20/32; B65H 2301/44921; B41J 15/005; G03G 15/6517

USPC ..... 399/384; 101/DIG. 42

See application file for complete search history.

(56) References Cited

U.S. PATENT DOCUMENTS

| | | | | |
|---|---|---|---|---|
| 3,474,311 | A * | 10/1969 | Lewis, Jr. | 318/6 |
| 5,752,153 | A * | 5/1998 | Kreiter et al. | 399/384 |
| 6,055,408 | A * | 4/2000 | Creutzmann et al. | 399/384 |
| 2006/0125899 | A1 * | 6/2006 | Cornish et al. | 347/104 |

FOREIGN PATENT DOCUMENTS

| | | |
|---|---|---|
| JP | 2944175 | 6/1999 |
| JP | 2007-316411 | 12/2007 |
| JP | 2009-186854 | 8/2009 |

* cited by examiner

*Primary Examiner* — Daniel J Colilla
*Assistant Examiner* — Justin Olamit
(74) *Attorney, Agent, or Firm* — Oblon, Spivak, McClelland, Maier & Neustadt, L.L.P.

(57) ABSTRACT

A printing system includes first and second printing apparatuses that form images on first and second surfaces of a continuous recording sheet, respectively. The second printing apparatus includes a printing unit that forms a toner image on the sheet; a conveying unit that conveys the sheet at a reference speed in the printing unit; a fixing-conveying unit that conveys the sheet and fixes the toner image adhered to the sheet; a buffer unit that takes up slack in the sheet generated because of a difference in conveyance between the conveying unit and the fixing-conveying unit; a determining unit that determines a brake force for stopping conveyance of the fixing-conveying unit, based on a buffer amount of the buffer unit, which corresponds to the slack in the sheet; and a conveyance control unit that performs control to stop conveyance of the sheet by the determined brake force.

9 Claims, 10 Drawing Sheets

111

| CONTROL DATA | 10 | ~ | 100 | ~ | 200 | ~ |
|---|---|---|---|---|---|---|
| OIL RATE | 10% | ~ | 100% | ~ | 200% | ~ |

PRINTING SYSTEM AND PRINTING APPARATUS USING CONTINUOUS RECORDING SHEET, AND CONVEYANCE CONTROL METHOD OF CONTINUOUS RECORDING SHEET

CROSS-REFERENCE TO RELATED APPLICATIONS

The present application claims priority to and incorporates by reference the entire contents of Japanese Patent Application No. 2010-009938 filed in Japan on Jan. 20, 2010 and Japanese Patent Application No. 2010-287976 filed in Japan on Dec. 24, 2010.

BACKGROUND OF THE INVENTION

1. Field of the Invention

The present invention relates to a printing system that forms images on both sides of a continuous recording sheet by using a first printing apparatus, which forms an image on a first surface, and a second printing apparatus, which forms an image on a second surface, and relates to a printing apparatus and a conveyance control method.

2. Description of the Related Art

FIG. 14 is a cross-sectional view of an entire configuration of a conventional printing apparatus employed in some types of printing systems.

A web conveying mechanism of a printing apparatus P includes a web conveying unit 8 that conveys a web (roll sheet) W at a reference speed; a fixing-conveying unit 13 that nips and conveys the web W by a heat roll 13*b*, which is driven to rotate by a motor, and a pressing roller 13*c*, which is in pressure contact with the heat roll 13*b* so as to rotate therewith; and a buffer unit 12 that takes up slack in the web W, which is caused by a difference in conveyance between the web conveying unit 8 and the fixing-conveying unit 13.

The web W is conveyed such that the web conveying unit 8, which is located on the upstream side, first conveys the web W at the reference speed, and the heat roll 13*b* of the fixing-conveying unit 13, which is located on the downstream side, performs rotation control in accordance with an output of the buffer unit 12 and conveys the web W so as to follow the reference speed while applying heat and pressure to the web W to fix a toner image formed thereon.

When the web conveyance is to be stopped, a stop timing of the fixing-conveying unit 13 is changed in accordance with an output of a buffer-amount sensor 12*b*, so that a buffer position at the time of stop of the web conveyance reaches a specific stop position.

As a conventional stop control method, a technology has been proposed in which a brake amount is adjusted in accordance with change in the conveying amount of the heat roll 13*b* per tiny unit of time while the heat roll 13*b* is decelerating for stopping printing (see, for example, Japanese Patent Application Laid-open No. 2007-316411).

As for a brake force on the heat roll 13*b*, there has been known a method of applying a reverse voltage on a motor that is used as a driving source of the heat roll 13*b* or a method of using a brake force that is generated by directly applying a load on the heat roll 13*b*. Further, a friction load that occurs at a contact portion of the web W in the printing apparatus may be used as a brake force. In order to reduce influence of the friction load on the web W, variation in a braking distance at the time of stop of the web conveyance is reduced by increasing a reverse voltage applied to a motor as a brake force or increasing a load directly applied to the heat roll 13*b*.

However, when the web conveyance speed is increased, an inertial force in a conveying direction of the web W increases. In this case, if the brake force remains great, stress to strain on the heat roll 13*b* increases and the heat roll 13*b* is easily torn. Therefore, it is necessary to lower the brake force with increase in the speed.

In recent years, however, various webs made of various materials are used and the brake force on the heat roll 13*b* greatly varies depending on the materials or a ream weight of the web W. Therefore, the rate of stopping the heat roll 13*b* by the friction load applied by the web W is increasing, so that a difference in a braking distance at the time of stop of the web conveyance may occur.

When duplex printing is performed on the web W, another printing apparatus P is serially disposed on the subsequent stage of the printing apparatus P such that the printing apparatus P on the preceding stage performs printing on a front side of the web W and the printing apparatus P on the subsequent stage performs printing on a back side of the web W. Therefore, oil applied to the heat roll 13*b* in the fixing-conveying unit 13 adheres to the web W and the web W with the oil is conveyed to the printing apparatus P on the subsequent stage. Consequently, a difference in a frictional force occurs due to the oil adhered to the web W and a braking distance may vary in the printing apparatus P on the subsequent stage.

However, when variation in the braking distance of the web W increases as above, and if a web conveying amount of the fixing-conveying unit 13 at the time of stop of the web conveyance is decreased, the buffer amount between the web conveying unit 8 and the fixing-conveying unit 13 increases, leading to slack in the web W on a buffer plate 12*a*. When the web conveying amount of the fixing-conveying unit 13 is increased, the buffer amount between the web conveying unit 8 and the fixing-conveying unit 13 decreases, so that the web W may be overly pulled toward the fixing-conveying unit 13 side and may be torn, which is a problem.

In particular, in the above-mentioned system in which another printing apparatus P is serially disposed on the subsequent stage of the printing apparatus P in order to perform duplex printing on the web W such that the printing apparatus P on the preceding stage performs printing on the front side of the web W and the printing apparatus P on the subsequent stage performs printing on the back side of the web W, because oil applied to the heat roll 13*b* in the fixing-conveying unit 13 adheres to the web W and the web W with the oil is conveyed to the printing apparatus P on the subsequent stage, a difference in a frictional force occurs due to the oil adhered to the web W in the printing apparatus P on the subsequent stage. Therefore, variation in the braking distance increases and the web W may be frequently torn, which makes it difficult to smoothly perform printing operations.

SUMMARY OF THE INVENTION

It is an object of the present invention to at least partially solve the problems in the conventional technology.

According to an aspect of the present invention, there is provided a printing system that includes a first printing apparatus that forms an image on a first surface of a continuous recording sheet; and a second printing apparatus that is disposed on a subsequent stage of the first printing apparatus and forms an image on a second surface of the continuous recording sheet. The second printing apparatus includes a printing unit that forms a toner image on the continuous recording sheet; a conveying unit that conveys the continuous recording sheet at a reference speed in the printing unit; a fixing-conveying unit that conveys the continuous recording sheet and fixes the toner image adhered to the continuous recording sheet; a buffer unit that takes up slack in the continuous recording sheet, the slack being generated because of a difference in conveyance between the conveying unit and the fixing-conveying unit; a determining unit that determines a brake force used for stopping conveyance of the fixing-conveying unit, based on a buffer amount of the buffer unit, the buffer amount corresponding to the slack in the continuous recording sheet; and a conveyance control unit that performs control to stop conveyance of the continuous recording sheet by the determined brake force.

According to another aspect of the present invention, there is provided a printing apparatus that includes a printing unit that forms a toner image on the continuous recording sheet; a conveying unit that conveys the continuous recording sheet at a reference speed in the printing unit; a fixing-conveying unit that conveys the continuous recording sheet and fixes the toner image adhered to the continuous recording sheet; a buffer unit that takes up slack in the continuous recording sheet, the slack being generated because of a difference in conveyance between the conveying unit and the fixing-conveying unit; a determining unit that determines a brake force used for stopping conveyance of the fixing-conveying unit, based on a buffer amount of the buffer unit, the buffer amount corresponding to the slack in the continuous recording sheet; and a conveyance control unit that performs control to stop conveyance of the continuous recording sheet by the determined brake force.

According to still another aspect of the present invention, there is provided a conveyance control method implemented by a printing apparatus that includes a printing unit that forms a toner image on the continuous recording sheet; a conveying unit that conveys the continuous recording sheet at a reference speed in the printing unit; a fixing-conveying unit that conveys the continuous recording sheet and fixes the toner image adhered on the continuous recording sheet; a buffer unit that takes up slack in the continuous recording sheet, the slack being generated because of a difference between conveyance by the conveying unit and conveyance by the fixing-conveying unit; and a determining unit that determines a brake force used for stopping conveyance of the fixing-conveying unit, based on a buffer amount of the buffer unit, the buffer amount corresponding to the slack in the continuous recording sheet. The conveyance control method includes determining a brake force used for stopping conveyance of the fixing-conveying unit, based on the buffer amount of the buffer unit, which corresponds to the slack in the continuous recording sheet; and performing control to stop conveyance of the continuous recording sheet by the determined brake force.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be described in detail below with reference to the accompanying drawings. The embodiments described below are specific examples and do not limit the present invention.

First Embodiment

Figure 1:
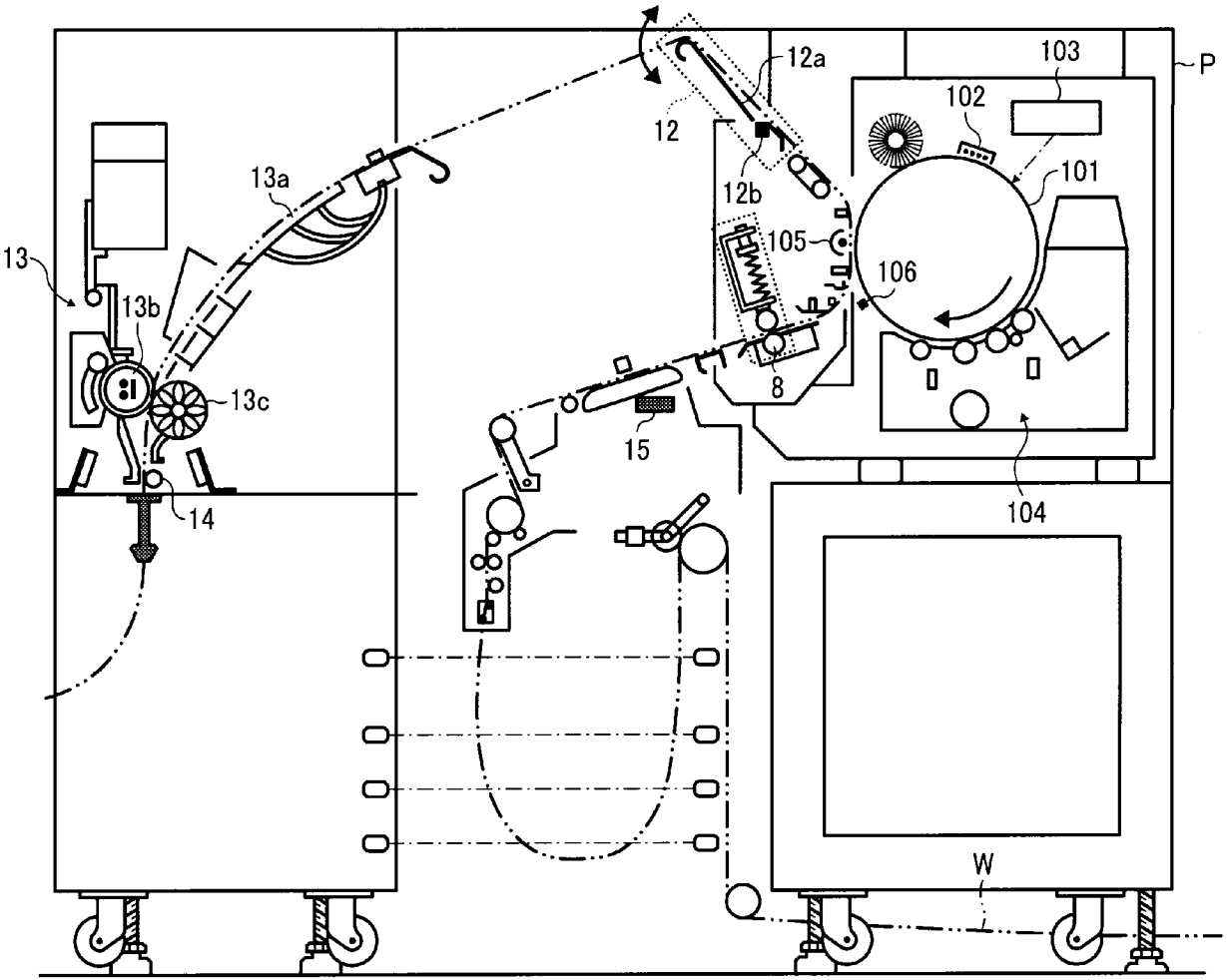
FIG. 1 is a cross-sectional view of an example of an entire configuration of a printing apparatus according to a first embodiment.
Figure 2:
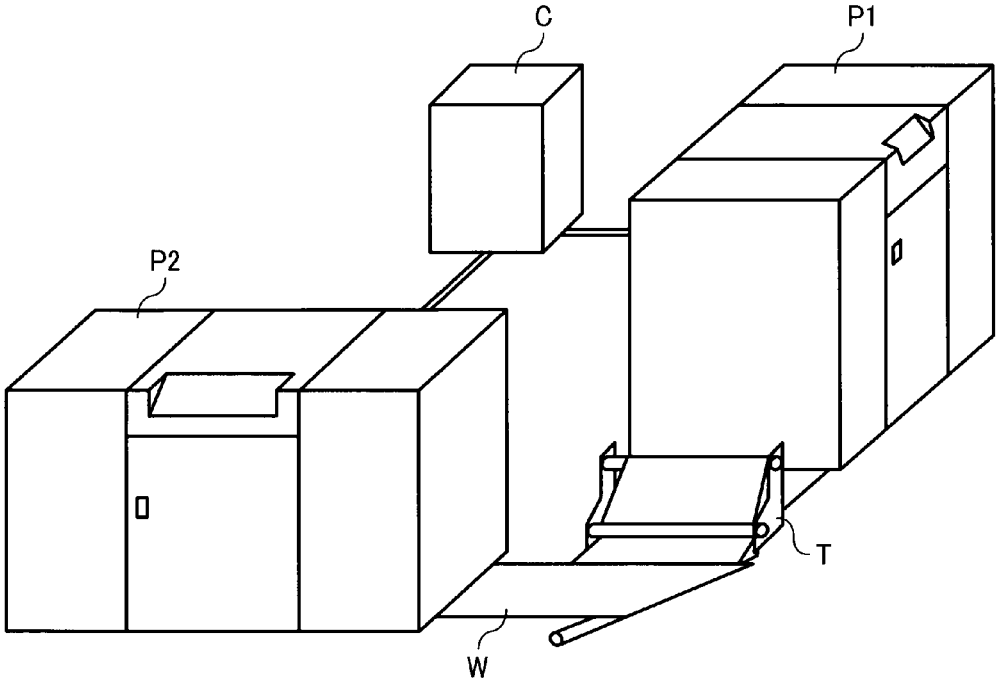
FIG. 2 is a perspective view of an external appearance of a printing system according to the first embodiment.
Figure 14:
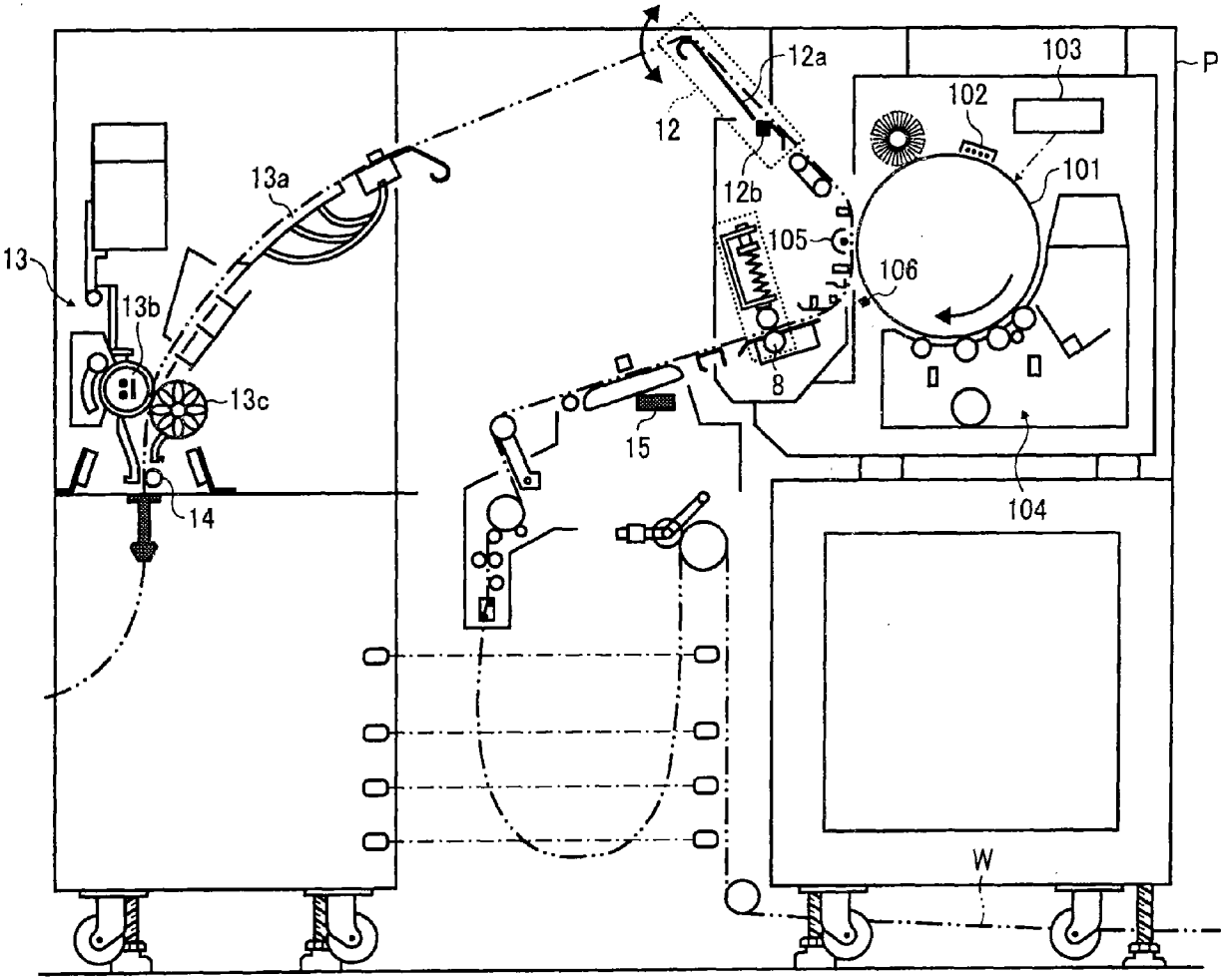
FIG. 14 RELATED ART
FIG. 14 is a cross-sectional view of an example of an entire configuration of a conventional printing apparatus.

A configuration of an electrophotographic printing apparatus, which is applied to a printing system according to a first embodiment, will be described below with reference to FIG. 1 and FIG. 2. FIG. 1 is a cross-sectional view of an internal configuration of a printing apparatus according to the first embodiment (the basic configuration is the same as the configuration shown in FIG. 14); and FIG. 2 is a perspective view of an external appearance of a printing system that performs duplex printing by using the printing apparatus shown in FIG. 1.

In the figures, paper is generally used as a web W that is a continuous recording sheet. In a printing apparatus P, a charging unit 102 applies an electrical charge to a photosensitive drum 101, and an exposing unit 103 applies an exposure pattern based on print data, so that an electrostatic latent image is formed on the photosensitive drum 101. A developing unit 104 then develops the electrostatic latent image on the photosensitive drum 101, so that a toner image is formed on the photosensitive drum 101. That is, the photosensitive drum 101, the charging unit 102, the exposing unit 103, the developing unit 104, and the like constitute a printing unit for forming an image on the web W. Conditions for forming a toner image are adjusted depending on an output of a toner-adhesion-amount sensor 106. The web W is conveyed to a transfer area by the web conveying unit 8, and a transfer unit 105 transfers the toner image onto the web W. The toner image on the web W is heated to near a transition temperature of toner resin while passing through a pre-heater 13*a*, and then fused and fixed to the web W by a fixing device that is formed of the heat roll 13*b*, which has a built-in heater, and the pressing roller 13*c*.

The printing apparatus P performs web conveyance such that the web conveying unit 8, which is located on the upstream side, conveys the web W at a reference speed, the heat roll 13*b* of the fixing-conveying unit 13, which is located on the downstream side, performs rotation control in accordance with an output of the buffer-amount sensor 12*b*, and the heat roll 13*b* and the pressing roller 13*c*, which is in pressure contact with the heat roll 13*b* so as to rotate therewith, apply heat and pressure to fix the toner image on the web W so as to follow the reference speed.

Described below is an example of a stop control method performed by the fixing-conveying unit 13 in a printing system that performs duplex printing on the web W by using the above printing apparatus P.

When each of printing apparatuses P1 and P2 stops web conveyance, a stop timing of the heat roll 13*b* is changed in accordance with an output of the buffer-amount sensor 12*b*, so that a buffer position at the time of stop of the web conveyance reaches a specific stop position.

When the printing system for duplex printing is constructed, another printing apparatus P may be prepared and installed as shown in FIG. 2. In the printing system in which the second printing apparatus P2 is additionally disposed on the subsequent stage of the first printing apparatus P1, the web W that is delivered by the heat roll 13*b* and the pressing roller 13*c* passes through a delivery roller 14 and is discharged to the outside of the first printing apparatus P1. Because of the installation as shown in FIG. 2, the front and back sides of the web W, which has been delivered from the preceding first printing apparatus P1, are reversed by a reversing device T (guide means). Then the web W is delivered into the second printing apparatus P2 and an image is formed on the second surface of the web W.

The first printing apparatus P1 and the second printing apparatus P2 are connected to a print control apparatus C so as to perform bi-directional communication and individually transmit various data. Therefore, settings can be made on each of the printing apparatuses P1 and P2, and the printing apparatuses P1 and P2 operate in cooperation with each other in response to a command from the print control apparatus C.

Generally, the printing apparatus P may be used as the first printing apparatus P1 or the second printing apparatus P2. The printing apparatus P determines whether it is used as the first printing apparatus P1 or the second printing apparatus P2 by acquiring control information from the print control apparatus C. When used as the first printing apparatus P1, the printing apparatus P sets a reference brake force that is applied to the heat roll 13*b* for stopping conveyance in the first printing apparatus P1. When used as the second printing apparatus P2, the printing apparatus P sets a reference brake force that is applied to the heat roll 13*b* for stopping conveyance in the second printing apparatus P2.

Figure 3:
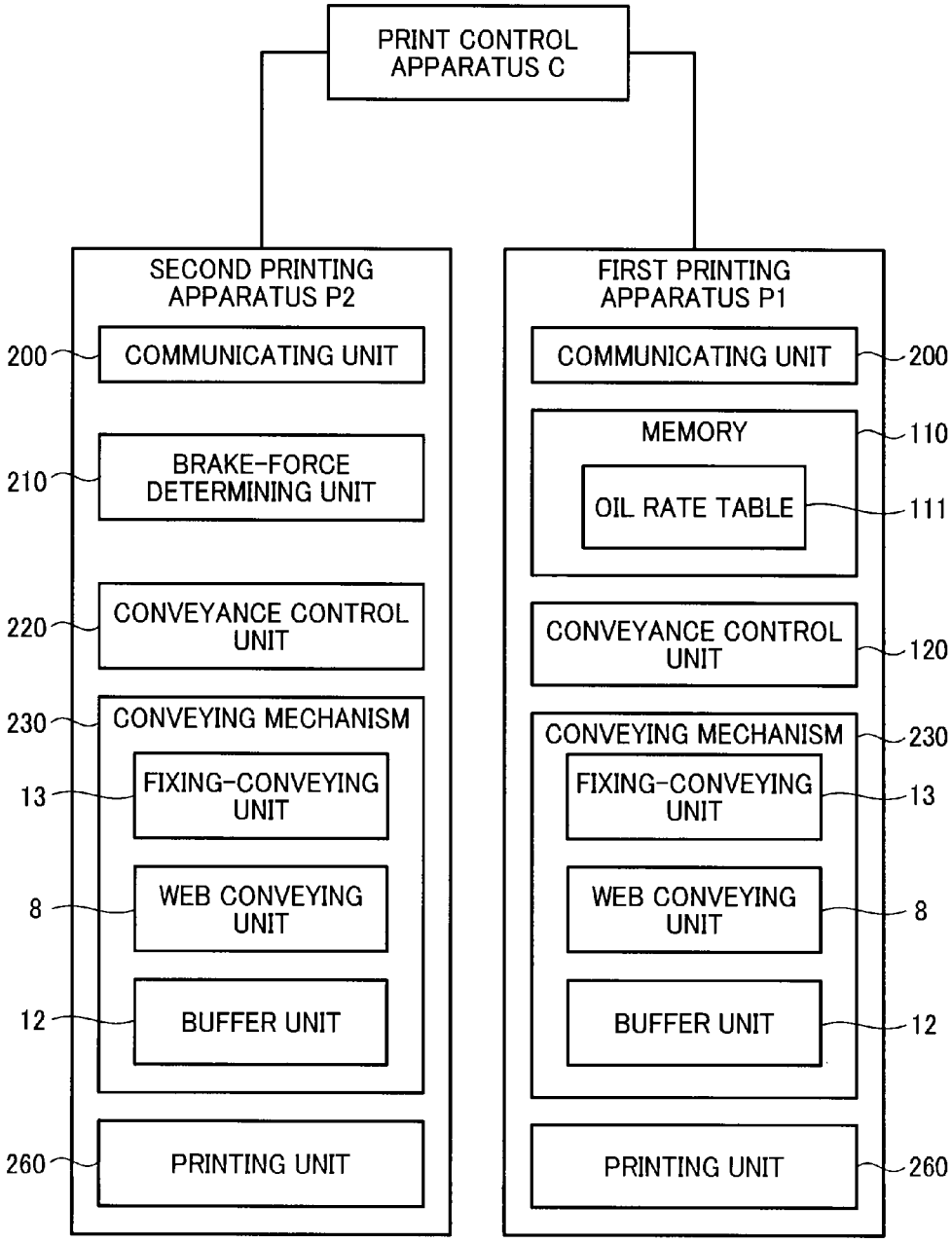
FIG. 3 is a block diagram of functional configurations of printing apparatuses P1 and P2 according to the first embodiment.

FIG. 3 is a block diagram of functional configurations of the printing apparatuses P1 and P2 according to the first embodiment. As shown in FIG. 3, the first printing apparatus P1 mainly includes a communicating unit 200, a memory 110, a conveyance control unit 120, a conveying mechanism 230, and a printing unit 260. The conveying mechanism 230 includes the fixing-conveying unit 13, the web conveying unit 8, and the buffer unit 12, which are described above. The conveyance control unit 120 controls web conveyance performed by the fixing-conveying unit 13 and the web conveying unit 8. The printing unit 260 forms an image on the surface of a web. The communicating unit 200 transmits and receives various data to and from the print control apparatus C.

Figures 4, 5:
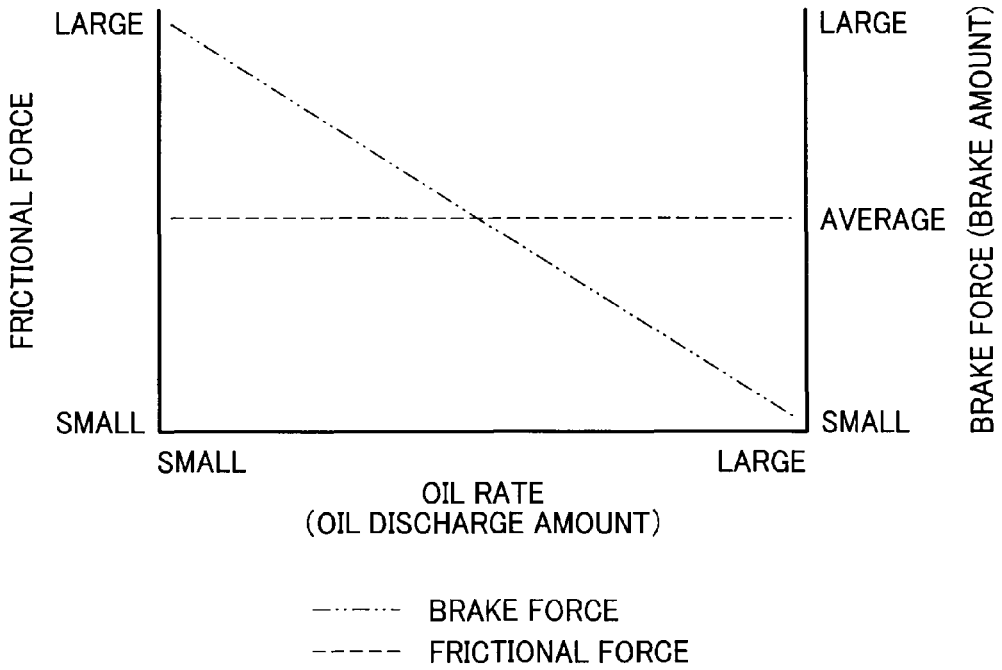
FIG. 4 is an explanatory diagram illustrating an example of an oil rate table 111.
FIG. 5 is a diagram illustrating a relationship between an oil rate and a frictional force on a web W when a brake force is maintained constant.

The memory 110 stores therein an oil rate table 111 and a current oil discharge amount. FIG. 4 is an explanatory diagram illustrating an example of the oil rate table 111.

The oil rate table 111 is a table in which control data and oil rate are associated with each other. The print control apparatus C transmits setting information on the first printing apparatus P1 in accordance with print conditions when performing printing operations. The printing apparatuses P1 and P2 receive the setting information by the communicating unit 200. The setting information contains control data corresponding to the oil rate that is changed depending on the conditions such as print density.

That is, when setting or changing the oil rate for the first printing apparatus P1, the print control apparatus C transmits control data according to the oil rate table 111 shown in FIG. 4. The first printing apparatus P1 that has received the control data from the print control apparatus C stores, in the memory 110, an oil discharge amount of oil to be applied to the web W as a current oil discharge amount in accordance with the oil rate corresponding to the control data, and controls oil discharging in accordance with the oil discharge amount.

The communicating unit 200 of the first printing apparatus P1 transmits the current oil discharge amount of the first printing apparatus P1, which is set in the memory 110, to the print control apparatus C. The print control apparatus C transmits the received current oil discharge amount of the first printing apparatus P1 to the second printing apparatus P2.

The control data may be set by a user via an operator panel 15 instead of receiving from the print control apparatus C.

As shown in FIG. 3, the second printing apparatus P2 mainly includes the communicating unit 200, a brake-force determining unit 210, a conveyance control unit 220, the conveying mechanism 230, and the printing unit 260. The communicating unit 200, the conveying mechanism 230, and the printing unit 260 have the same functions and configurations as those of the first printing apparatus P1. The communicating unit 200 of the embodiment receives the current oil discharge amount of the first printing apparatus P1 from the print control apparatus C.

The brake-force determining unit 210 determines a brake force for stopping conveyance in the fixing-conveying unit 13 based on the buffer amount of the buffer unit 12 in accordance with slack in the web W. The current oil discharge amount of the first printing apparatus P1 causes variation in the buffer amount of the buffer unit 12 in the second printing apparatus P2. Therefore, the brake-force determining unit 210 of the embodiment determines the brake force based on the current oil discharge amount of the first printing apparatus P1, which has been received by the communicating unit 200 from the print control apparatus C.

Figure 6:
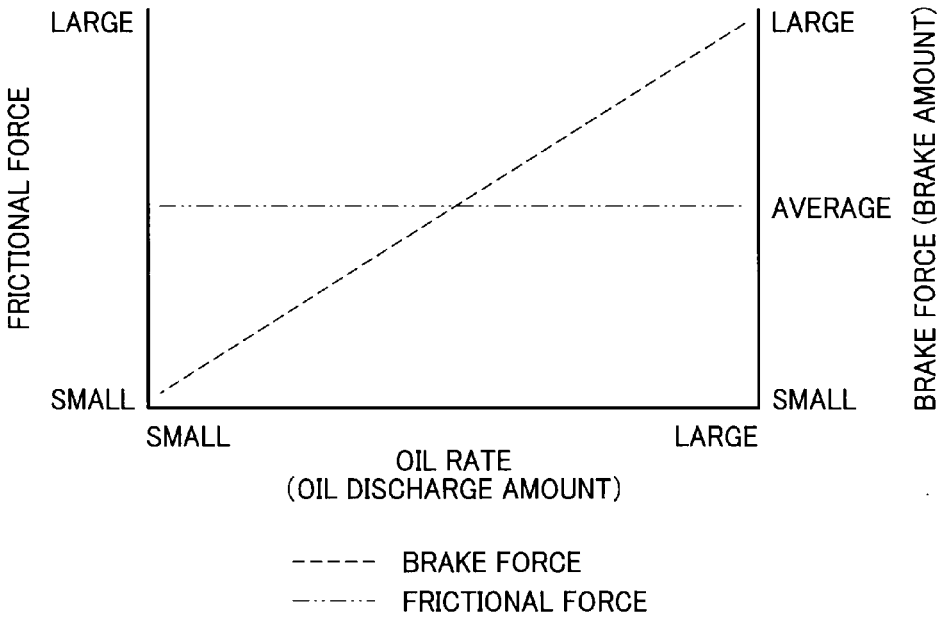
FIG. 6 is a diagram illustrating a relationship between an oil rate and a frictional force on a web W when a brake force is changed according to the oil rate.

FIG. 5 is a diagram illustrating a relationship between an oil rate and a frictional force on the web W when a brake force is maintained constant; and FIG. 6 is a diagram illustrating a relationship between an oil rate and a frictional force on the web W when a brake force is changed according to the oil rate.

As shown in FIG. 5, when duplex printing is performed on the web W, and if a brake force is maintained constant in the second printing apparatus P2 that performs printing on the back side, a braking distance during braking varies because a frictional force varies depending on oil that has adhered to the web W in the first printing apparatus P1.

According to the embodiment, as shown in FIG. 6, the brake force in the second printing apparatus P2 is changed in accordance with the oil discharge amount that is based on the oil rate of the first printing apparatus P1, so that the frictional force due to the oil adhered to the web W can be canceled out and the braking distance can be maintained constant.

That is, when the received oil discharge amount of the first printing apparatus P1 is greater than a standard oil discharge amount of the first printing apparatus P1, i.e., when the increased amount of oil is discharged, the amount of oil adhered to the surface of the web W to be conveyed to the second printing apparatus P2 side increases and thereby the frictional force on the web W decreases. Therefore, the brake-force determining unit 210 of the second printing apparatus P2 sets an increased brake force by correcting a brake force, which is proportional to the rate of decrease in the frictional force, to the reference brake force, which is set for the heat roll 13*b* for stopping conveyance.

On the other hand, when the received oil discharge amount of the first printing apparatus P1 is smaller than the standard oil discharge amount of the first printing apparatus P1, i.e., when the decreased amount of oil is discharged, the amount of oil adhered to the surface of the web W to be conveyed to the second printing apparatus P2 side decreases and thereby the frictional force on the web W increases. Therefore, the brake-force determining unit 210 of the second printing apparatus P2 sets a decreased brake force by correcting a brake force, which is proportional to the rate of increase in the frictional force, to the reference brake force, which is set for the heat roll 13*b* for stopping conveyance.

Referring back to FIG. 3, the conveyance control unit 220 of the embodiment performs control to stop conveyance of the web W by the brake force determined by the brake-force determining unit 210. The conveyance stop control will be described in detail below.

Figure 7:
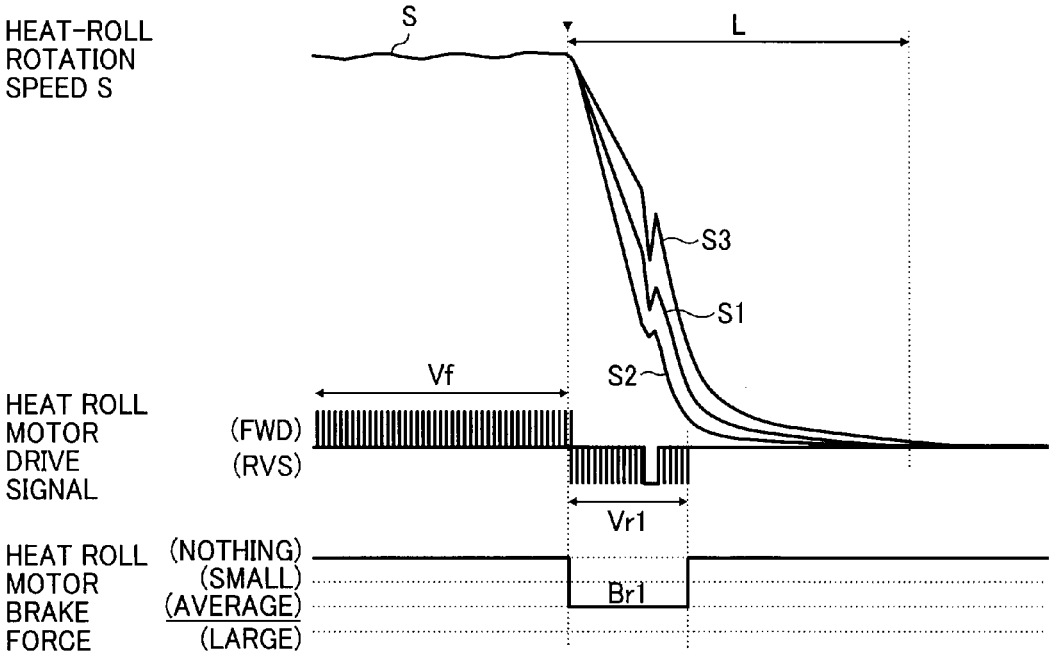
FIG. 7 is an explanatory diagram illustrating a first example of a relationship between rotation speed of a heat roll and a voltage of a heat roll motor.

FIG. 7 is an explanatory diagram illustrating a relationship between rotation speed of the heat roll 13*b* and the brake force of a heat roll motor. As shown in FIG. 7, the rotation speed of the heat roll 13*b* during web conveyance is high, and a heat roll motor drive signal Vf in a FWD (forward) direction is output to the heat roll motor so as to follow the speed of the web conveying unit 8. When the conveyance of the web W is to be stopped, it may be possible to directly apply a load on the heat roll 13*b* to stop the conveyance. However, as a preferable mode of the embodiment, a method will be described below in which the conveyance is quickly stopped with a short stopping distance L by applying a reverse voltage by a servomotor, outputting a heat-roll drive signal Vr1 in a RVS (reverse) direction to the heat roll motor, and applying a voltage in a direction to cause a reverse operation.

When the heat roll 13*b* is stopped by a brake force Br1 according to the heat-roll drive signal Vr1 in the RVS direction of the heat roll motor, and if a friction load applied to the heat roll 13*b* is a standard load, a heat-roll decelerating curve S1 is obtained. Therefore, the web conveying amounts of the web conveying unit 8 and the fixing-conveying unit 13 become equal to each other, so that the buffer plate 12*a* has a predetermined buffer amount after the web conveyance is stopped.

Even when the heat roll 13*b* is stopped by the same brake force, if the oil discharge amount of the first printing apparatus P1 is smaller than the standard amount and the friction load applied to the heat roll 13*b* is greater than the standard load, time taken for the stop decreases and a heat-roll decelerating curve S2 is obtained. Therefore, the web conveying amount of the fixing-conveying unit 13 becomes smaller than that of the web conveying unit 8. As a result, the buffer amount of the buffer plate 12*a* after the stop of the web conveyance increases.

Further, even when the heat roll 13*b* is stopped by the same brake force, if the oil discharge amount of the first printing apparatus P1 is greater than the standard amount and the friction load applied to the heat roll 13*b* is smaller than the standard load, time taken for the stop increases and a heat-roll decelerating curve S3 is obtained. Therefore, the web conveying amount of the fixing-conveying unit 13 becomes greater than that of the web conveying unit 8. As a result, the buffer amount of the buffer plate 12*a* after the stop of the web conveyance decreases.

Moreover, even with the same brake force, the buffer amount of the buffer plate 12*a* at the time of stop of the web conveyance varies due to the friction load, which is applied to the heat roll 13*b* based on the oil discharge amount of the printing apparatus P1. Therefore, in order to obtain a predetermined buffer amount of the buffer plate 12*a* at the time of stop of the web conveyance, it is necessary to equalize the web conveying amount between the web conveying unit 8 and the fixing-conveying unit 13 by changing the brake force of the heat roll motor.

Figure 8:
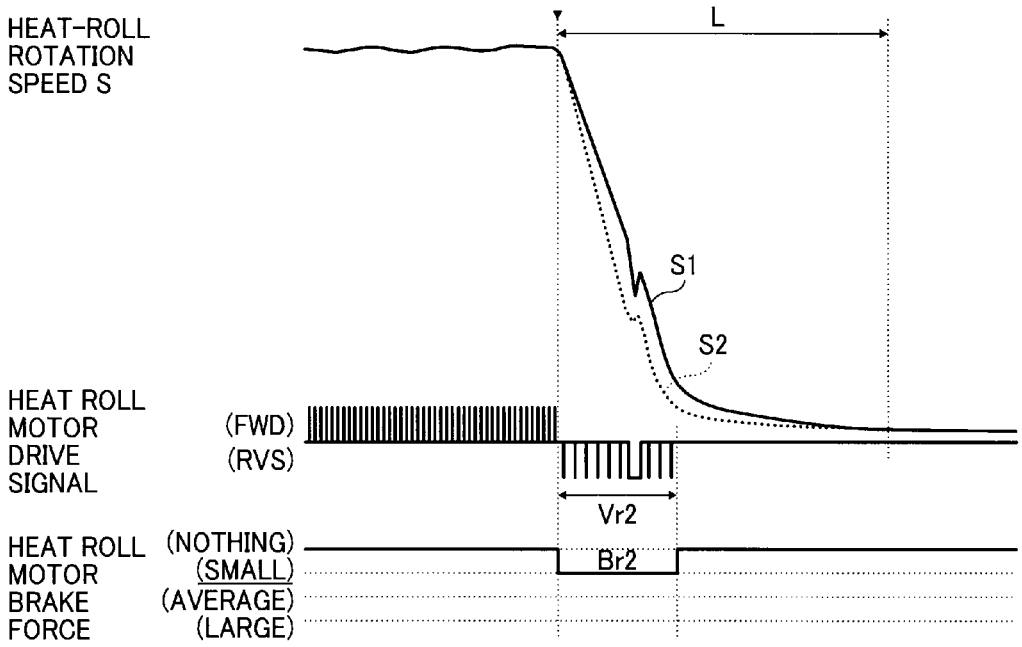
FIG. 8 is an explanatory diagram illustrating a second example of the relationship between the rotation speed of the heat roll and the voltage of a heat roll motor.

A correction method for the case where the above friction load is applied will be described below with reference to FIG. 8 and FIG. 9. As shown in FIG. 8, when the oil discharge amount of the first printing apparatus P1 is smaller than the standard amount and the friction load applied to the heat roll 13*b* is thereby greater than the standard load, i.e., when the heat-roll decelerating curve S2 is obtained, the buffer amount of the buffer plate 12*a* after the web conveyance is stopped is detected and the brake force Br1 corresponding to the drive signal Vr1 in the RVS direction of the heat roll motor is corrected to a brake force Br2 corresponding to a corrected drive signal Vr2. Therefore, a load on the heat roll 13*b* is reduced and the conveying amount is increased, so that the heat-roll decelerating curve S1 is obtained. As a result, a predetermined buffer amount of the buffer plate 12*a* can be obtained at the time of stop of the web conveyance.

Figure 9:
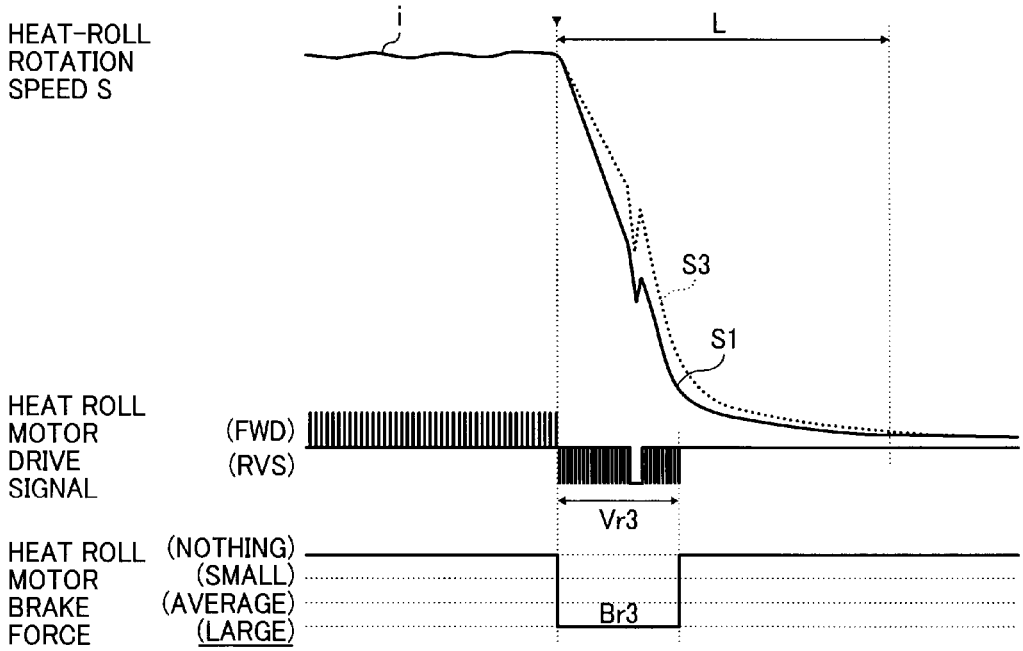
FIG. 9 is an explanatory diagram illustrating a third example of the relationship between the rotation speed of the heat roll and the voltage of the heat roll motor.

Similarly, as shown in FIG. 9, when the oil discharge amount of the first printing apparatus P1 is greater than the standard amount and the friction load applied to the heat roll 13*b* is thereby smaller than the standard load, i.e., when the heat-roll decelerating curve S3 is obtained, the buffer amount of the buffer plate 12*a* after the web conveyance is stopped is detected and the brake force Br1 corresponding to the drive signal Vr1 in the RVS direction of the heat roll motor is corrected to a brake force Br3 corresponding to a corrected drive signal Vr3. Therefore, a load on the heat roll 13*b* is increased and the conveying amount is decreased, so that the heat-roll decelerating curve S1 is obtained. As a result, a predetermined buffer amount of the buffer plate 12*a* can be obtained at the time of stop of the web conveyance. As described above, it is possible to appropriately cope with variation in the friction load applied to the heat roll 13*b*.

Figure 10:
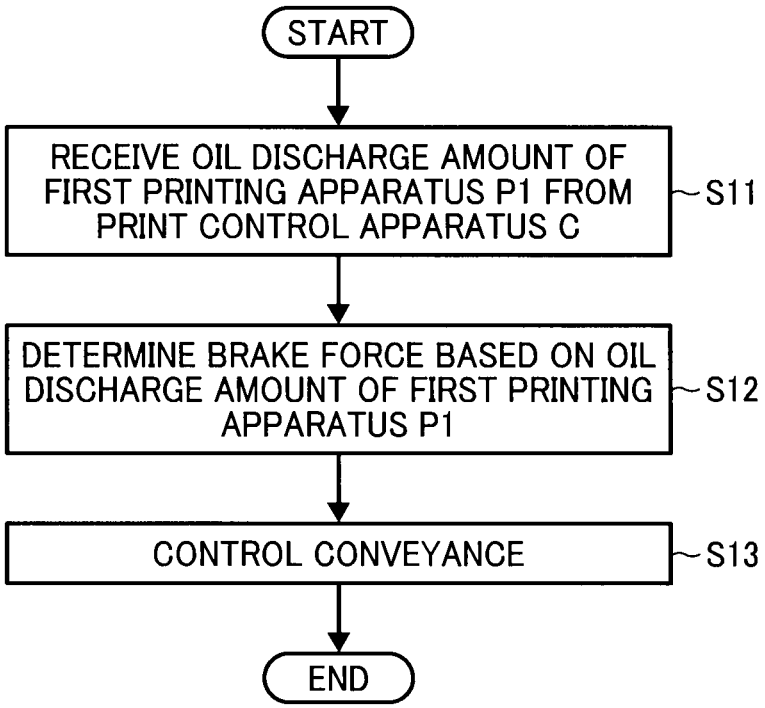
FIG. 10 is a flowchart of a procedure of a conveyance stop control process performed by the second printing apparatus P2 according to the first embodiment.

Next, a conveyance stop control process performed on the web W by the second printing apparatus P2 of the embodiment, which is configured as above, will be described below. FIG. 10 is a flowchart of a procedure of the conveyance stop control process performed by the second printing apparatus P2 according to the first embodiment.

In the second printing apparatus P2, the communicating unit 200 receives the current oil discharge amount of the first printing apparatus P1 from the print control apparatus C (Step S11). The brake-force determining unit 210 determines a brake force based on the received current oil discharge amount of the first printing apparatus P1 as described above (Step S12). The conveyance control unit 220 performs conveyance control to stop conveyance by the determined brake force (Step S13).

As described above, according to the embodiment, because the oil discharge amount onto the web W in the first printing apparatus P1 influences the buffer amount of the buffer unit 12 of the second printing apparatus P2, the oil discharge amount of the first printing apparatus P1 is received via the print control apparatus C and a brake force for stopping conveyance of the web W by the second printing apparatus P2 is determined based on the received oil discharge amount. Therefore, it is possible to prevent the web W from being torn, so that duplex printing can be performed smoothly and efficiently. As a result, it is possible to output images with more stable and good quality.

Modification

The print control apparatus C may be structured such that it previously calculates a reference brake force to be applied to the heat roll 13*b* for stopping conveyance in the second printing apparatus P2, based on the oil discharge amount received from the first printing apparatus P1, transmits the calculated brake force to the second printing apparatus P2, and causes the second printing apparatus P2 to set the transmitted brake force. Even in this case, the same advantages as above can be achieved.

For a wide variety of webs W, it is possible for the printing apparatus P to cause the print control apparatus C or external input means such as the operator panel 15 to set reference brake-force data, which is previously adjusted for a web W and is used for the heat roll 13*b* for stopping conveyance, to each of the first printing apparatus P1 and the second printing apparatus P2. Accordingly, it is possible to stably perform control to stop the fixing-conveying unit.

Second Embodiment

In the first embodiment, because the oil discharge amount onto the web W in the first printing apparatus P1 influences the buffer amount of the buffer unit 12 of the second printing apparatus P2, the second printing apparatus P2 determines a brake force based on the oil discharge amount of the first printing apparatus P1.

However, even when the reference brake force, which is applied to the heat roll 13*b* for stopping conveyance, is changed in advance depending on the conditions of the oil discharge amount of the first printing apparatus P1 or the second printing apparatus P2, there may be a case in which a buffer position at the time of stop of the web conveyance cannot reach a specific stop position.

Therefore, according to the second embodiment, the buffer amount of the buffer unit 12 of the second printing apparatus P2 is directly detected and a brake force is determined based on the detected buffer amount.

Figure 11:
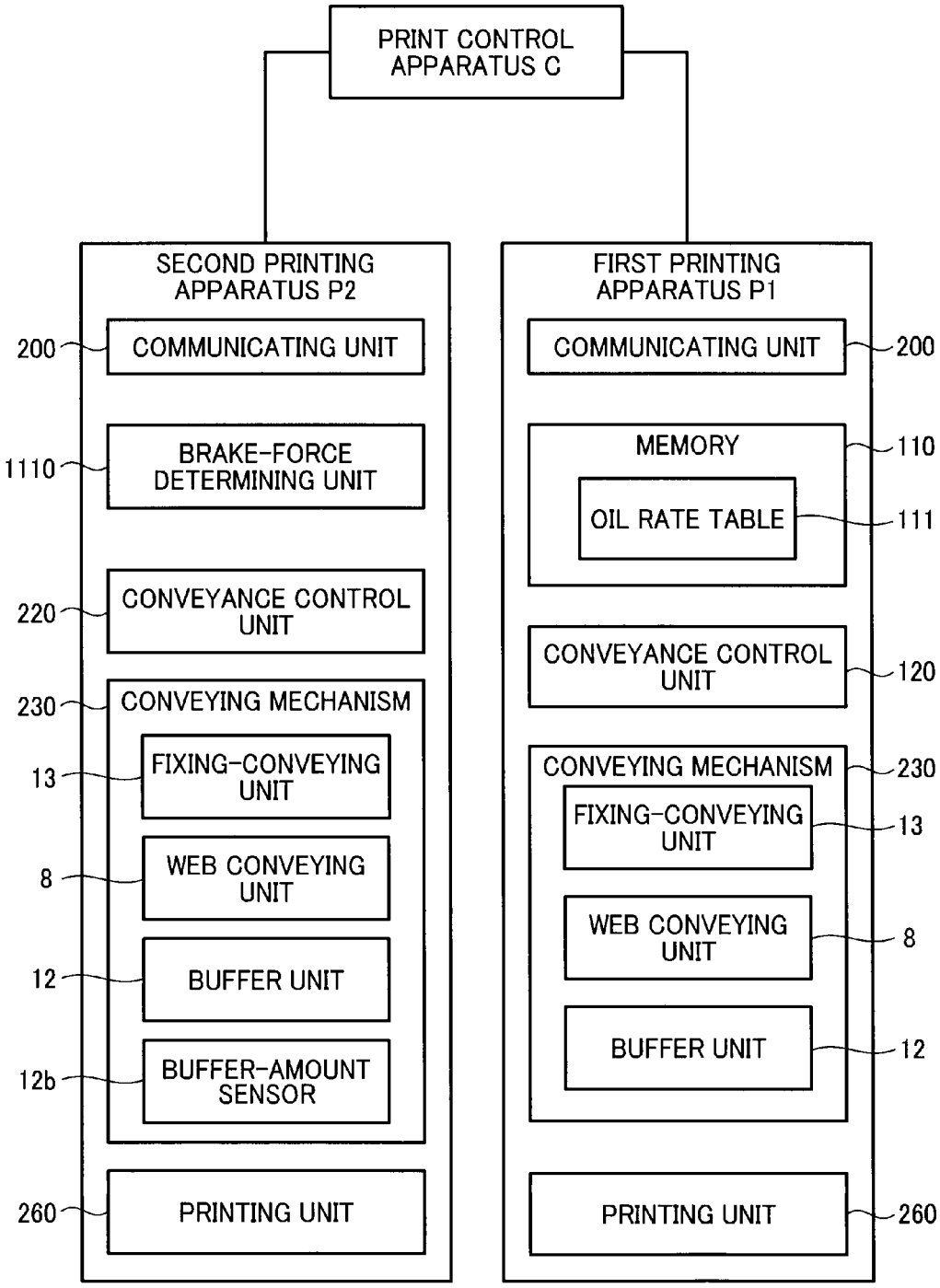
FIG. 11 is a block diagram of functional configurations of printing apparatuses P1 and P2 according to a second embodiment.

FIG. 11 is a block diagram of functional configurations of printing apparatuses P1 and P2 according to the second embodiment. The configuration of the first printing apparatus P1 is the same as that of the first embodiment.

As shown in FIG. 11, the second printing apparatus P2 mainly includes the communicating unit 200, a brake-force determining unit 1110, the conveyance control unit 220, the conveying mechanism 230, and the printing unit 260. The communicating unit 200, the conveying mechanism 230, and the printing unit 260 have the same functions and configurations as those of the first printing apparatus P1. In FIG. 11, the buffer-amount sensor 12*b* described in the first embodiment is shown in the conveying mechanism 230.

Figure 12:
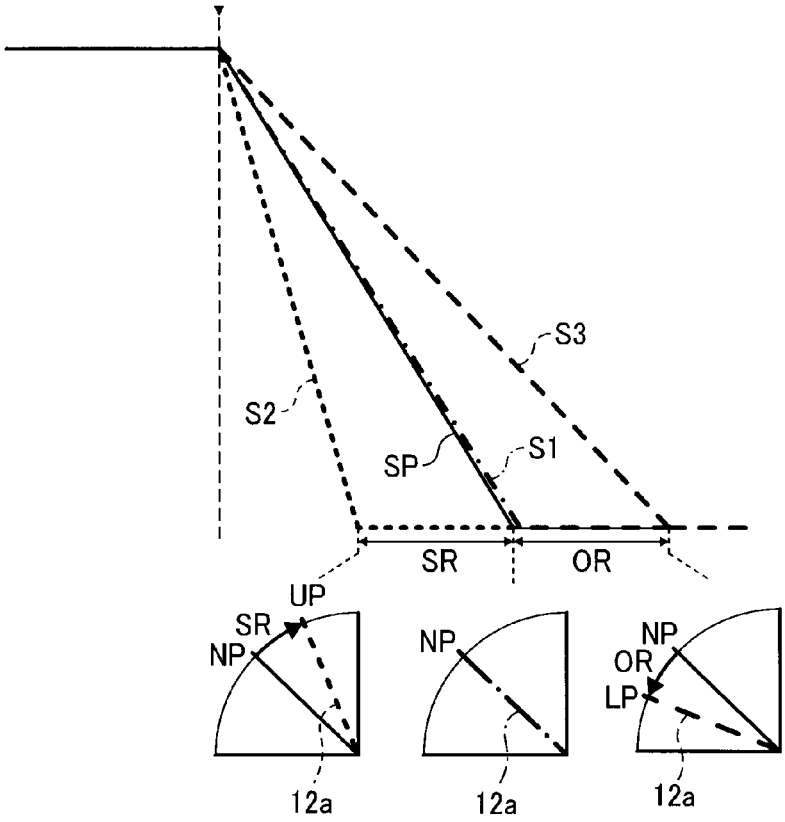
FIG. 12 is an explanatory diagram illustrating a relationship between a heat-roll braking distance and a buffer plate position at the time of stop of conveyance.

According to the embodiment, the brake-force determining unit 1110 determines a brake force for stopping conveyance of the web W based on the buffer amount detected by the buffer-amount sensor 12*b*. FIG. 12 is an explanatory diagram illustrating a relationship between a heat-roll braking distance and a buffer plate position at the time of stop of the conveyance.

As shown in FIG. 12, when a load applied to the heat roll 13*b* is standard and a braking distance becomes equal to that of a decelerating curve SP of the web conveying unit 8, which conveys the web W at the reference speed, as with the heat-roll decelerating curve S1, a difference in the braking distance does not occur between the web conveying unit 8 and the fixing-conveying unit 13. Therefore, a position of the buffer plate 12*a* at the time of stopping the conveyance of the web W reaches a neutral position NP. Therefore, when the buffer-amount sensor 12*b* detects the neutral position NP, the brake-force determining unit 1110 determines a brake force equal to the standard brake force.

However, when the rate of the load on the heat roll 13*b* is decreased, and a braking distance becomes longer than that of the decelerating curve SP of the web conveying unit 8, which conveys the web W at the reference speed, as with the heat-roll decelerating curve S3, the position of the buffer plate 12*a* at the time of stop of the web conveyance reaches a LOWER position LP because of a braking distance difference OR between the web conveying unit 8 and the fixing-conveying unit 13. Therefore, when the buffer-amount sensor 12*b* detects the LOWER position LP, the brake-force determining unit 1110 determines a brake force greater than the reference brake force.

Similarly, when the rate of the load on the heat roll 13*b* is increased, and a braking distance becomes shorter than that of the decelerating curve SP of the web conveying unit 8, which conveys the web W at the reference speed, as with the heat-roll decelerating curve S2, the position of the buffer plate 12*a* at the time of stopping the conveyance of the web W reaches an UPPER position UP because of a braking distance difference SR between the web conveying unit 8 and the fixing-conveying unit 13. Therefore, when the buffer-amount sensor 12*b* detects the UPPER position UP, the brake-force determining unit 1110 determines a brake force smaller than the reference brake force.

Figure 13:
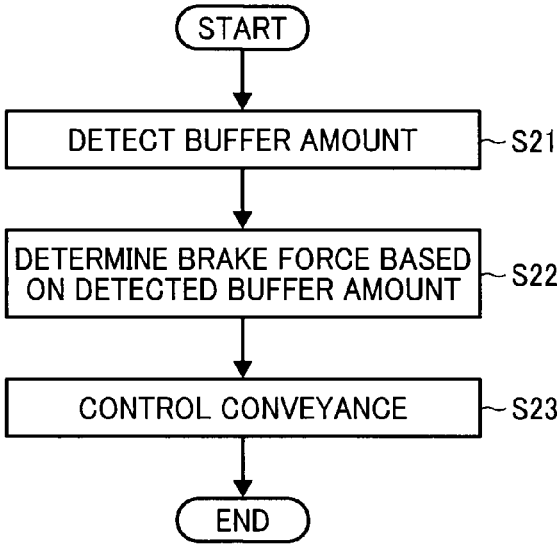
FIG. 13 is a flowchart of a procedure of a conveyance stop control process performed by the second printing apparatus P2 according to the second embodiment.

A conveyance stop control process performed on the web W by the second printing apparatus P2 according to the embodiment, which is configured as above, will be described below. FIG. 13 is a flowchart of a procedure of the conveyance stop control process performed by the second printing apparatus P2 according to the second embodiment.

In the second printing apparatus P2, the buffer-amount sensor 12*b* detects the buffer amount of the buffer unit 12 (Step S21). The brake-force determining unit 1110 determines a brake force based on the detected buffer amount as described above (Step S22). The conveyance control unit 220 performs conveyance control to stop conveyance by the determined brake force (Step S23).

According to the embodiment, it is possible to change a web conveying amount of the fixing-conveying unit 13 by adjusting a brake force, which is applied to the heat roll motor next time the web conveyance is stopped, based on an output of the buffer-amount sensor 12*b* at the time of stop of the web conveyance, and changing a load on the heat roll 13*b*. Therefore, even when the first printing apparatus P1 or the printing apparatus P, which is free from the influence of the oil discharge amount, is used as stand alone it is possible to control the buffer amount, so that a position of the buffer plate 12*a* at the time of stop of the web conveyance can reach a predetermined position even when a material of the heat roll 13*b*, a material of the web, or a load on the heat roll 13*b* is changed. Consequently, it is possible to solve the problem in that the web W is torn because of slack in the web W on the buffer plate 12*a* or over pulling of the web W by the fixing-conveying unit 13.

Modification

Because time taken for stopping the web conveyance depends on the conveying speed of the web W, it is necessary to change the brake force. Therefore, it is possible to perform control by changing a method of calculating the brake correction amount in the buffer amount when the web conveyance is stopped. With this configuration, it is possible to widely cope with various changes in conditions.

According to the second embodiment, the method is described in which the buffer amount at the time of stop of the web conveyance is referred to and a brake force is calculated based on a calculation result to obtain a brake force that is applied to the heat roll motor next time the conveyance is stopped. However, it is possible to perform the same control by generating a table for the heat roll motor and the brake force based on measurement results obtained in advance, and selecting and setting a brake force, which is applied next time the conveyance is stopped, based on the buffer amount by referring to the table.

According to the present invention, a difference in the conveying amount of a continuous recording sheet between units is eliminated at the time of stop of printing in each printing apparatus, so that the continuous recording sheet is prevented from being torn. Therefore, it is possible to smoothly and efficiently perform duplex printing and output image with more stable and good quality.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A printing system comprising:

a first printing apparatus that forms an image on a first surface of a continuous recording sheet; and a second printing apparatus that is disposed on a subsequent stage of the first printing apparatus and forms an image on a second surface of the continuous recording sheet, wherein the second printing apparatus includes a printing unit that forms a toner image on the continuous recording sheet;

a conveying unit that conveys the continuous recording sheet at a reference speed in the printing unit;

a fixing-conveying unit that conveys the continuous recording sheet and fixes the toner image adhered to the continuous recording sheet;

a buffer unit that buffers slack in the continuous recording sheet, the slack being generated because of a difference in conveyance between the conveying unit and the fixing-conveying unit;

a buffer amount sensor that detects a buffer amount of the buffer unit when conveyance of the continuous recording sheet has stopped, the buffer amount corresponding to the slack in the continuous recording sheet;

a determining unit that determines a brake force applied to the fixing-conveying unit a next time conveyance of the continuous recording sheet is to be stopped, based on the buffer amount of the buffer unit, the determining unit determining the brake force based on a position of the buffer unit, the brake force being different for different positions of the buffer unit, and the determining unit determining a standard brake force when the buffer unit is at a neutral position, which is when a braking distance of the conveying unit is equal to a braking distance of the fixing-conveying unit and when a standard load is applied to the fixing-conveying unit, determining a greater brake force than the standard brake force when the buffer unit is at a lower position from the neutral position, and determining a smaller brake force than the standard brake force when the buffer unit is at an upper position from the neutral position; and a conveyance control unit that controls, when conveyance of the continuous recording sheet is stopped the next time, the fixing-conveyor unit to stop the conveyance of the continuous recording sheet by the determined brake force.

2. The printing system according to claim 1, wherein the second printing apparatus further includes an input unit that receives input of the brake force, and the determining unit determines the brake force input via the input unit as a brake force applied to the fixing-conveying unit.

3. The printing system according to claim 1, wherein the first printing apparatus includes an input unit that receives input of the brake force, and the second printing apparatus includes an input unit that receives input of the brake force.

4. The printing system according to claim 1, wherein the determining unit determines the brake force in accordance with a conveying speed of the continuous recording sheet.

5. A printing apparatus comprising:

a printing unit that forms a toner image on the continuous recording sheet;

a conveying unit that conveys the continuous recording sheet at a reference speed in the printing unit;

a fixing-conveying unit that conveys the continuous recording sheet and fixes the toner image adhered to the continuous recording sheet;

a buffer unit that buffers slack in the continuous recording sheet, the slack being generated because of a difference in conveyance between the conveying unit and the fixing-conveying unit;

a buffer amount sensor that detects a buffer amount of the buffer unit when conveyance of the continuous recording sheet has stopped, the buffer amount corresponding to the slack in the continuous recording sheet;

a determining unit that determines a brake force applied to the fixing-conveying unit a next time conveyance of the continuous recording sheet is to be stopped, based on the buffer amount of the buffer unit, the determining unit determining the brake force based on a position of the buffer unit, the brake force being different for different positions of the buffer unit, and the determining unit determining a standard brake force when the buffer unit is at a neutral position, which is when a braking distance of the conveying unit is equal to a braking distance of the fixing-conveying unit and when a standard load is applied to the fixing-conveying unit, determining a greater brake force than the standard brake force when the buffer unit is at a lower position from the neutral position, and determining a smaller brake force than the standard brake force when the buffer unit is at an upper position from the neutral position; and a conveyance control unit that controls, when conveyance of the continuous recording sheet is stopped the next time, the fixing-conveying unit to stop the conveyance of the continuous recording sheet by the determined brake force.

6. A conveyance control method implemented by a printing apparatus that includes a printing unit that forms a toner image on the continuous recording sheet;

a conveying unit that conveys the continuous recording sheet at a reference speed in the printing unit;

a fixing-conveying unit that conveys the continuous recording sheet and fixes the toner image adhered on the continuous recording sheet;

a buffer unit that buffers slack in the continuous recording sheet, the slack being generated because of a difference between conveyance by the conveying unit and conveyance by the fixing-conveying unit;

a buffer amount sensor that detects a buffer amount of the buffer unit when conveyance of the continuous recording sheet has stopped, the buffer amount corresponding to the slack in the continuous recording sheet; and a determining unit that determines a brake force applied to the fixing-conveying unit a next time conveyance of the continuous recording sheet is to be stopped, based on the buffer amount of the buffer unit, the conveyance control method comprising:

detecting the buffer amount of the buffer unit when conveyance of the continuous recording sheet has stopped, the buffer amount corresponding to the slack in the continuous recording sheet;

determining the brake force applied to the fixing-conveying unit the next time the conveyance of the continuous recording sheet is to be stopped, based on the buffer amount of the buffer unit, the determining determines the brake force based on a position of the buffer unit, the brake force being different for different positions of the buffer unit, and the determining determines a standard brake force when the buffer unit is at a neutral position, which is when a braking distance of the conveying unit is equal to a braking distance of the fixing-conveying unit and when a standard load is applied to the fixing-conveying unit, determines a greater brake force than the standard brake force when the buffer unit is at a lower position from the neutral position, and determines a smaller brake force than the standard brake force when the buffer unit is at an upper position from the neutral position; and performing, when the conveyance of the continuous recording sheet is stopped the next time, control to stop the conveyance of the continuous recording sheet by the determined brake force.

7. The printing system according to claim 1, further comprising:

a memory that stores a table including a plurality of position ranges, which include the neutral position, the lower position, and the upper position, each associated with a heat roll motor of the fixing-conveying unit and a brake force, which include the standard brake force, the greater brake force, and the smaller brake force, wherein the determining unit determines an appropriate brake force by referring to the table and selecting a brake force associated with an appropriate position range of the buffer amount.

8. The printing system according to claim 1, wherein the first printing apparatus and the second printing apparatus are connected to a print control apparatus and perform bi-directional communication.

9. The printing system according to claim 1, wherein the first printing apparatus includes a fixing-conveying unit that conveys the continuous recording sheet and fixes the toner image adhered to the continuous recording sheet, and a buffer unit that buffers the slack in the continuous recording sheet.

* * * * *